US012152586B2

(12) United States Patent
Mrowczynski

(10) Patent No.: US 12,152,586 B2
(45) Date of Patent: Nov. 26, 2024

(54) HYDRAULIC MACHINE WITH LUBRICATED ROTATING SPOOL

(71) Applicant: White Drive Motors and Steering sp. z.o.o., Kobierzyce (PL)

(72) Inventor: Adam Mrowczynski, Kobierzyce (PL)

(73) Assignee: WHITE DRIVE MOTORS AND STEERING SP. Z.O.O., Kobierzyce (PL)

( * ) Notice: Subject to any disclaimer, the term of this patent is extended or adjusted under 35 U.S.C. 154(b) by 0 days.

(21) Appl. No.: 18/206,304

(22) Filed: Jun. 6, 2023

(65) Prior Publication Data

US 2023/0313793 A1 Oct. 5, 2023

Related U.S. Application Data

(63) Continuation of application No. PCT/EP2021/084710, filed on Dec. 8, 2021.

(30) Foreign Application Priority Data

Dec. 14, 2020 (EP) ..... 20213831

(51) Int. Cl.
*F04C 2/10* (2006.01)
*F04C 15/00* (2006.01)

(52) U.S. Cl.
CPC ..... *F04C 2/104* (2013.01); *F04C 2/103* (2013.01); *F04C 15/0088* (2013.01); *F04C 15/0096* (2013.01); *F04C 2240/60* (2013.01)

(58) Field of Classification Search
CPC ..... F04C 2/104; F04C 2/103; F04C 15/0088; F04C 15/0096; F04C 2240/60
See application file for complete search history.

(56) References Cited

U.S. PATENT DOCUMENTS 3,606,598 A 9/1971 Albers
3,841,800 A * 10/1974 Ohrberg ..... F04C 2/104 418/61.3

(Continued)

FOREIGN PATENT DOCUMENTS

FR 2232689 X 1/1975

OTHER PUBLICATIONS

International Search Report, PCT/EP2021/084710, International Filing Date Dec. 8, 2021.

(Continued)

*Primary Examiner* — Mary A Davis
(74) *Attorney, Agent, or Firm* — Ralph E. Jocke; WALKER & JOCKE

(57) ABSTRACT

A hydraulic machine (1) has a working section (6) and a fluid control section (28). The fluid control section includes a spool (3) that is rotatable in a cylindrical bore (30) about an axis (4). A distributor plate (18) extends intermediate of the control section and the working section. The spool includes an axial recess (10) which is axially bounded by a radially extending annular wall (44). A front face (48) of the annular wall rotates in abutting engagement with a plate face contact area (50) of the distributor plate. Hydraulic fluid flows through at least one groove (52) that extends radially and circumferentially across the abutting areas of the spool and the distributor plate to provide lubrication and heat absorption.

20 Claims, 3 Drawing Sheets

(56) References Cited

U.S. PATENT DOCUMENTS

| | | | | | |
|---|---|---|---|---|---|
| 3,853,435 | A | * | 12/1974 | Ogasahara | F04C 2/104 137/625.21 |
| 4,082,480 | A | | 4/1978 | McDermott | |
| 4,872,819 | A | | 10/1989 | White, Jr. | |
| 5,407,336 | A | | 4/1995 | White | |

OTHER PUBLICATIONS

Writtten Opinion of the International Searching Authority, PCT/EP2021/084710, International Filing Date Dec. 8, 2021.

* cited by examiner

HYDRAULIC MACHINE WITH LUBRICATED ROTATING SPOOL

TECHNICAL FIELD

Exemplary arrangements relate to hydraulic machines such as hydraulic motors and hydraulic pumps. Exemplary arrangements further relate to structures within such hydraulic machines that are operative to selectively route the flow of hydraulic fluid during machine operation.

BACKGROUND

Hydraulic machines often operate by selectively routing the flow of hydraulic fluid within the machine. In many situations the flow of hydraulic fluid within the machine is at high pressures. Arrangements for routing the flow of hydraulic fluid may be subject to leakage, deformation and/or wear due to the high pressures and axially acting load forces that are encountered.

Some environments in which such conditions may rise include hydraulic machines that include gerotor arrangements. Some such hydraulic machines which include gerotor arrangements may operate as positive displacement pumps. Other hydraulic machines which include gerotor arrangements may operate as hydraulic motors. Other types of hydraulic machines may include other types of hydraulic components for which the routing of flow must be accurately and efficiently controlled.

Prior arrangements for such hydraulic machines may benefit from improvements.

SUMMARY

Exemplary arrangements relate to a hydraulic machine that includes a housing. The exemplary housing includes a working section that includes a gerotor. The exemplary housing further includes a flow control section with an arrangement for directing the flow of hydraulic fluid to and from the areas bounded by the gear teeth of the gerotor.

An exemplary hydraulic fluid flow directing arrangement includes a cylindrical bore which extends along an axis within the machine. The bore is bounded by a cylindrical bore wall that includes angularly spaced fluid openings each of which is configured to deliver or receive hydraulic fluid.

A cylindrical spool extends in the bore and is rotatable within the bore about an axis. The spool includes a generally cylindrical outer surface. The exemplary outer surface includes a pair of axially disposed radially inwardly extending first and second circumferential grooves. Each of the circumferential grooves is bounded radially inwardly by a respective bottom wall surface.

A plurality of angularly disposed first axial grooves extend radially inward in the spool. Each of the first axial grooves extends axially intermediate of the first and second circumferential grooves. Each of the first axial grooves extends in intersecting relation with the first circumferential groove. The intersecting relation between the first axial grooves in the first circumferential groove enables hydraulic fluid to flow between the first axial grooves and the circumferential groove.

A plurality of angularly disposed second axial grooves extend radially inward in the spool. Each of the second axial grooves extend axially intermediate of the first and second circumferential grooves. Each of the second axial grooves also extends in intersecting relation with the second circumferential groove enabling hydraulic fluid flow therebetween.

Each second axial groove is positioned angularly intermediate of the pair of immediately adjacent first axial grooves.

The exemplary arrangement may be used in a machine configuration in which the spool has an axially extending recess that includes an internally splined portion configured for engaging a splined shaft. In some exemplary arrangements this shaft may include a dog bone or cardan shaft that is in operative connection with an orbital rotational star wheel of a gerotor. In such configurations the spool rotates in coordinated relation with the star wheel of the gerotor which coordinates the flow of hydraulic fluid within the machine.

In exemplary arrangements the spool is in operative connection with an external shaft that extends outside the housing of the machine. The shaft may be subject to externally applied axially directed forces. At an axial end opposed of the shaft, the spool includes a radially extending annular wall which includes a front face. The front face of the spool rotates within the cylindrical bore in abutting engagement with a contact area of a distributor plate.

To reduce friction and wear that would otherwise be caused by inwardly directed axial forces acting on the external shaft and the spool, at least one of the abutting front face of the spool and the contact area of the distributor plate includes at least one radially extending and circumferentially extending curved groove. Hydraulic fluid passes through the at least one groove which lubricates and absorbs heat from the abutting surfaces of the spool and the distributor plate. The at least one groove reduces wear and extends the operational life of the hydraulic machine.

Of course it should be understood that these hydraulic machine configurations are exemplary of numerous different configurations which apply the principles described herein.

DETAILED DESCRIPTION

Figure 1:
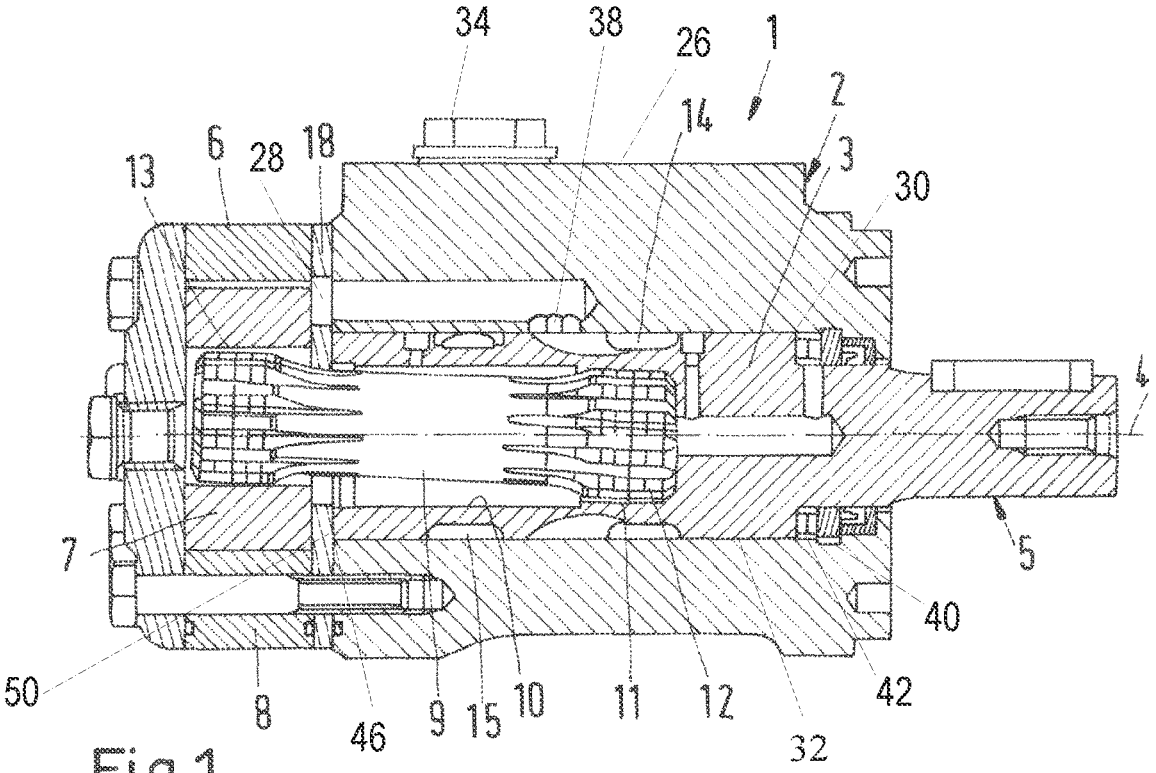
FIG. 1 is a cross sectional view of an exemplary hydraulic machine including the features of an exemplary arrangement.

Exemplary arrangements relate to a machine that receives hydraulic fluid through an inlet port, supplies the fluid to a working section of the machine such as a gerotor, receives fluid from the working section and delivers it from the machine such as through an outlet port. In some exemplary arrangements the working section may operate as a hydraulic pump. In other exemplary arrangements the working section may operate as a hydraulic motor. In other exemplary arrangements the working section may operate as a different type of hydraulic device.

An exemplary hydraulic machine in which a fluid directing arrangement is used to receive and direct hydraulic fluid under high pressure to a working section, and return hydraulic fluid with low pressure such as to a return tank, is shown in U.S. Pat. No. 4,082,480 the disclosure of which is incorporated herein by reference in its entirety. Further exemplary hydraulic machines which include a fluid directing arrangement are shown in U.S. Pat. Nos. 3,606,598 and 5,407,336 the disclosures of each of which are also incorporated herein by reference in its entirety. These incorporated disclosures detail fluid directing arrangements which include certain features similar to those described herein which in exemplary arrangements direct internal hydraulic fluid flow as needed for operation of the machine.

In the exemplary arrangements described herein a hydraulic machine generally indicated 1 includes a housing 2. The exemplary machine includes a pair of hydraulic fluid ports generally indicated 34, only one of which is shown. The exemplary machine includes a hydraulic fluid inlet port and a hydraulic fluid outlet port. The exemplary housing includes a fluid control section 26 with an internal generally cylindrical bore 30. When used herein the term generally cylindrical means that a majority of the structure has a cylindrical shape. The bore 30 is bounded by a generally cylindrical bore wall 32.

A generally cylindrical spool 3 is positioned in the bore 30. The exemplary spool is rotatable in the bore 30 about an axis of rotation 4. The spool is axially stationary within the bore 30. The exemplary spool 2 is in operatively fixed rotatable connection with a spool shaft 5. The exemplary spool includes a generally cylindrical outer spool surface 36. In the exemplary arrangement the outer spool surface 36 is in close immediately adjacent facing relation with the cylindrical bore wall 32. In the exemplary arrangement close tolerances are maintained between the outer spool surface and the cylindrical bore wall to minimize fluid leakage between the fluid passages within the machine. Of course it should be understood that this approach is exemplary and in other arrangements other sealing methods may be used.

The exemplary machine includes a working section 6. In the exemplary arrangement the working section includes a gerotor. The exemplary gerotor includes a star wheel 7. The star wheel 7 extends within a ring gear 8. The star wheel 7 is arranged eccentrically within the ring gear 8. In the exemplary arrangement the star wheel includes a plurality of outward extending teeth. The ring gear includes a plurality of inward extending teeth which in the exemplary arrangement is one more tooth than the number of outward extending teeth on the star wheel. In the exemplary arrangement the star wheel 7 rotates within the interior area of the ring gear. The central axis of the star wheel also moves in an orbital manner. As the teeth of the star wheel and the ring gear sequentially engage, areas of increasing and decreasing volume between the teeth are produced in a manner like that described in the incorporated disclosures. In the exemplary arrangement in which the inlet port of the housing is supplied with hydraulic fluid at an elevated pressure, the star wheel is caused to move in a rotating and orbital manner in engagement with the ring gear as high pressure fluid is directed to cause expansion of the volume of certain areas that are bounded by the engaged teeth and fluid is directed out of other areas that are bounded by the engaged teeth to enable the reduction in the volume thereof.

The rotating and orbitally moving star wheel 7 is operatively connected to the spool 3 and causes the spool to rotate about the axis 4. The exemplary spool 3 includes an axially extending generally cylindrical spool axial recess 10 which is alternatively referred to herein as a hollow. The spool axial recess includes a splined portion 11 which is alternatively referred to herein as a splined region. A dog bone shaft which is alternatively referred to herein as a cardan shaft 9, operatively connects the star wheel 7 and the spool 3. The exemplary dog bone 9 comprises a splined end 12 which is in rotationally engaged connection with the splined portion 11 of the spool axial recess 10. The exemplary dog bone 9 further includes a further splined end 13 at an axially opposed end from the splined end 12. The splined end 13 is in rotationally engaged connection with a splined recess within the star wheel 7. Of course it should be understood that this arrangement is exemplary and in other arrangements other structures and configurations may be used.

The exemplary spool 3 comprises a radially inward extending first circumferential groove 14. The first circumferential groove 14 extends radially inward from the outer generally cylindrical spool surface 36. The spool 3 further includes a radially inward extending second circumferential groove 15 which similarly extends radially inward from the outer spool surface 36. The first circumferential groove 14 is axially disposed from the second circumferential groove 15.

A plurality of angularly spaced first axial grooves 16 extend radially inward in the spool from the outer cylindrical surface 36. In the exemplary arrangement the first axial grooves are uniformly angularly spaced circumferentially on the spool. Each of the first axial grooves is disposed angularly away from each of the other first axial grooves. Each of the first axial grooves 16 extends in intersecting relation with the first circumferential groove 14. In the exemplary arrangement a portion of the axial length of each of the first axial grooves is in intersecting relation with the first circumferential groove 14. This configuration is used in the exemplary arrangement to facilitate hydraulic fluid flow between the first axial grooves and the first circumferential groove. However it should be understood that this configuration is exemplary and in other arrangements other approaches may be used.

A plurality of angularly spaced second axial grooves 17 extend radially inward in the spool 3 from the spool outer surface 36. In the exemplary arrangement the second axial grooves are uniformly spaced circumferentially such that each second axial groove is angularly spaced away from each other second axial grooves. Each second axial groove 17 extends in intersecting relation with the second circumferential groove 50. Further in the exemplary arrangement a portion of the axial length of each second axial groove is in intersecting relation with the second circumferential groove 15. As can be appreciated the first axial grooves 16 do not engage in intersecting relation with the second circumferential groove 15, and the second axial grooves 17 do not engage in intersecting relation with the first circumferential groove 14.

Further in the exemplary arrangement each respective second axial groove 17 is angularly positioned in intermediate relation of each angularly immediately adjacent pair of first axial grooves 16. Likewise each respective first axial groove 16 is angularly positioned in intermediate relation of each angularly immediately adjacent pair of second axial grooves 17. As a result the first axial grooves 16 and the second axial grooves 17 are arranged alternatively about the circumference of the spool 3.

In the exemplary arrangement a distributor plate 18 extends axially between the working section 6 and the cylindrical bore 30. The distributor plate which may be of the type described in the incorporated disclosures, includes distributor plate openings 28 which provide fluid passages for hydraulic fluid that passes between the working section and fluid openings 38 and other fluid passages that extend in the housing 2. As can be appreciated in the exemplary arrangement the bore wall 32 includes a plurality of angularly disposed fluid openings which are configured to pass hydraulic fluid therethrough. In the exemplary arrangement the plurality of fluid openings are generally circularly aligned, which for purposes hereof means that they extend substantially within an annular area of the bore wall 32. Further the fluid openings are positioned axially intermediate of the first circumferential groove 14 and the second circumferential groove 15. This enables the axial grooves 15, 16 to be in axially overlapping relation with each of the fluid openings. As a result each axial groove is in fluid communication with the respective fluid opening with which the axial groove becomes radially aligned during rotation of the spool 3. As a result the exemplary arrangement enables directing hydraulic fluid along fluid paths within the housing as necessary to achieve the operation of the hydraulic machine.

Figure 3:
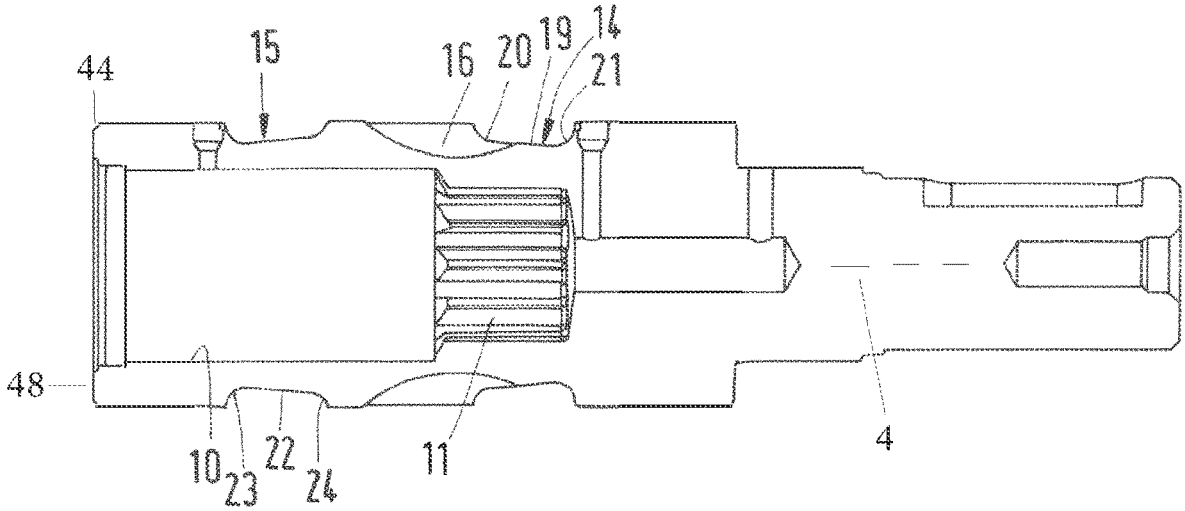
FIG. 3 is a transverse diametric cross sectional view of the exemplary spool.

As shown in transverse diametric cross section in FIG. 3, the exemplary spool 3 is configured such that each of the first circumferential groove 14 and the second circumferential groove 15 extend in radially outward overlying relation of the spool axial recess 10. The first circumferential groove 14 further extends at least partially in radially outwardly overlying relation of the splined portion 11.

Figure 2:
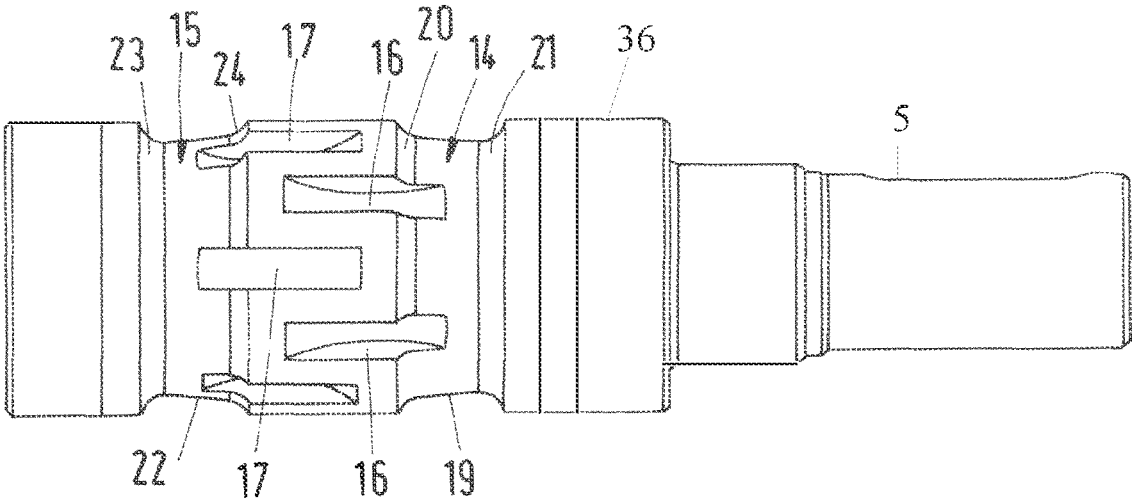
FIG. 2 is a side view of an exemplary spool used in the exemplary hydraulic machine arrangement.

In the exemplary arrangement the first circumferential groove 14 is radially inwardly bounded by a first bottom wall 19. The first bottom wall 19 extends axially between two transition areas 20, 21. The transition areas define the radially inward transition between the first bottom wall 19 and the side walls of the first circumferential groove 14. In the exemplary arrangement as shown in greater detail in FIG. 2, each first axial groove 16 extends in intersecting and overlapping relation with the first circumferential groove.

Figure 4:
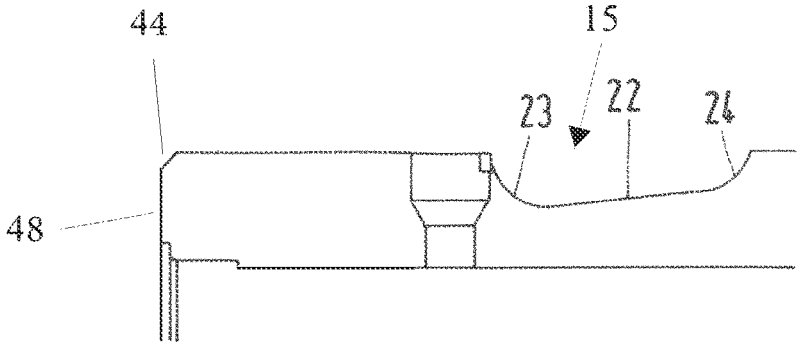
FIG. 4 is an enlarged portion of the spool shown in FIG. 3.

In the exemplary arrangement the second circumferential groove 15 is radially inwardly bounded in transverse diametric cross section by a second bottom wall 22. This is shown for example in FIG. 4. In cross section the second circumferential groove is bounded by second bottom wall 22 which extends between two transition regions, 23, 24. The transition regions 23, 24 provide a transition between the second bottom wall 22 and the side walls of the second circumferential groove along the circumferential direction.

In some exemplary arrangements it is desirable to have the configurations of the first and second circumferential grooves 14, 15 be a mirror image of one another in transverse diametric cross section. Likewise in some exemplary arrangements the axially extending grooves 16, 17 have a mirror image configuration. This provides for more uniform hydraulic fluid flow during rotation of the spool and operation of the hydraulic machine. Of course these approaches are exemplary and in other arrangements other approaches may be used.

Further in the exemplary configuration of the spool 3, each of the second axial grooves 17 extends in intersecting and overlapping relation with the second circumferential groove 15. This provides for desirable hydraulic fluid flow properties between the second axially extending grooves and the second circumferential groove.

In the exemplary arrangement the shaft 5 which extends outside the housing 2 of the machine may be subject to externally applied axial forces. This may be particularly true when the machine is operated as a motor. In the exemplary arrangement the spool 3 is supported within the housing 2 of the machine by a radial bearing 40 and an axial bearing 42. While in the exemplary arrangement these two bearings are shown as separate components, in other arrangements they may be combined in a single thrust bearing component.

The axial bearing 42 is operative to hold the spool in axially fixed position within the cylindrical bore 30 against axial forces which act on the shaft and tend to pull the shaft 5 and the spool 3 outwardly from the housing. However in some arrangements the axial bearing 42 does not effectively resist axial forces which tend to act to push the spool 3 inwardly.

In the exemplary machine arrangement the spool 3 includes a radially extending annular wall 44 which bounds an axially inward end of the spool. The radially extending wall extends between the spool axial recess 10 and a circumferential area 46 between the outer spool surface 36 and the cylindrical bore wall 32. The exemplary radially extending annular wall includes a front face 48. The front face 48 of the spool 3 rotates about the axis 4 within the cylindrical bore 30 in abutting engagement with an annular plate face contact area 50 of the distributor plate 18. As can be appreciated this annular contact area provides a face plate contact surface that extends in opposed facing relation with the plate engaging face surface of the spool, and resists the axially inward directed forces that may be applied to the spool.

At least one groove 52 is utilized in exemplary arrangements to provide controlled radial flow of hydraulic fluid across the front face 48 and the annular plate face contact area 50. The flow of hydraulic fluid through the at least one groove 52 operates to expose the abutting surfaces of the spool 3 and the distributor plate 18 to the flow of hydraulic fluid. This exposure to the hydraulic fluid and the flow of the fluid through the groove operates to reduce friction and to absorb heat from each of the abutting surfaces of the spool and the distributor plate. In exemplary arrangements at least one groove may extend in the plate engaging front face surface of the spool, in the plate face contact surface of the distributor plate, or both.

Figure 5:
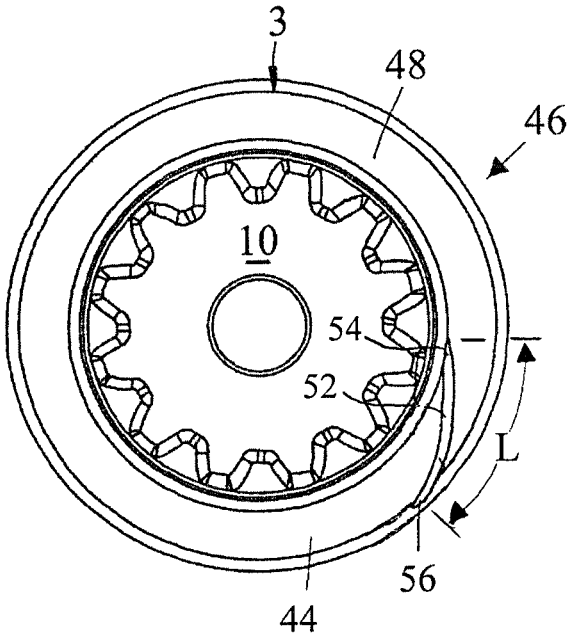
FIG. 5 is a front view of an exemplary spool and the axially extending recess therein.
Figure 6:
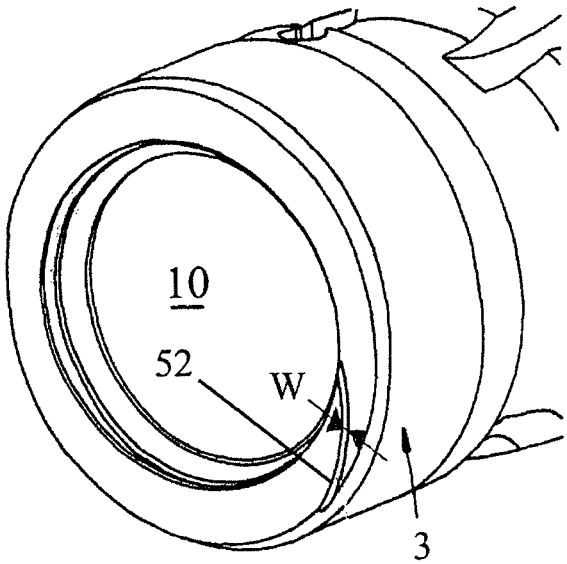
FIG. 6 is a perspective view of the axially inward end of the exemplary spool.

FIGS. 5 and 6 show an exemplary arrangement in which a single groove 52 extends in the front face 48 of the spool 3. In this exemplary arrangement the groove is a curved groove which extends in a direction that extends both radially and circumferentially relative to the spool and the contact area of the distributor plate. In this exemplary arrangement the flow of the hydraulic fluid within the curved groove 52 is distributed in the circumferential direction.

In the exemplary arrangement the groove extends an overall length in the circumferential direction (L) which is larger than the maximum transverse width (W) of the groove 52 in the direction in which the groove extends. Further in exemplary arrangements the groove extends angularly in the circumferential direction so as to provide a groove length in the circumferential direction which is equal to or larger than the radial length of the annular wall 44 of the spool. Thus for example the groove extends across an area which can be defined as within a square with the length of the sides of the square corresponding to the radial thickness of the wall of the spool surrounding the axial recess that extends in the spool. As a consequence, rotation of the spool is operative to drag the hydraulic fluid entering the groove over a relatively long distance across the contacting surface of the distributor plate.

The curved shape of the groove in the exemplary arrangement provides the advantage that the groove can be machined by turning. In some arrangements this enables formation of the groove using the machining processes that are utilized to form the spool axial recess and the splined portion therein. Further the curved shape provides that the length of the groove is longer than a directly radially extending groove so that a larger amount of hydraulic fluid can be contained and transported within the groove to lubricate and absorb heat from the surfaces of the spool and the distributor plate that are in abutting contact.

In the exemplary arrangement the groove 52 includes a radially inner opening 54 and a radially outer opening 56. The radially inner opening and radially outer opening are angularly offset from one another in the circumferential direction. This angular offset defines the length of the groove in the circumferential direction. The exemplary groove has a single gradient. In other words there is no reversal of the direction of the groove throughout the entire length of the groove. This exemplary configuration keeps the pressure loss associated with flow through the groove relatively low.

In exemplary arrangements the groove may have a depth in a direction parallel to the spool axis into the front face of 1 mm or less. In other exemplary arrangements the depth of the groove maybe 0.3 mm or less. In other exemplary arrangements the depth of the groove may be about 0.2 mm or less. While this is a relatively small groove depth, in the exemplary arrangements it is sufficient to provide adequate flow for lubrication and for heat absorption in the area of the abutting engagement between the front face of the spool and the contacting plate contact area of the distributor plate. Further maintaining the groove geometry, depth and width within the ranges indicated herein maintains the flow through the groove at a level which avoids excessive internal leakage and any significant loss in efficiency.

During operation of the hydraulic machine the at least one groove 52, whether extending in the front face of the spool or the contact area of the distributor plate, is filled with hydraulic fluid. The movement of the spool relative to the distributor plate drags the hydraulic fluid over the contact area in which the front face of the spool and the distributor plate are in abutting engagement. The curved configuration and circumferential length of the groove provides a relatively long path across the groove which increases the amount of hydraulic fluid that can be transported within the groove relative to the amount of fluid that could be transported if the groove extended only in the radial direction.

In exemplary arrangements the circumferentially extending groove facilitates hydraulic fluid contact with the abutting surfaces and propagates the distribution of the fluid in the circumferential direction. Further in some exemplary arrangements the greater length of the groove which results from the groove extending in a direction that extends both radially and circumferentially, increases the resistance to flow through the groove and maintains the amount of fluid that passes through the groove within a desired range. Further it should be appreciated that while in the arrangement shown that there is a single groove, in other exemplary arrangements where additional lubrication and cooling is needed, a plurality of angularly spaced grooves may be used. Of course it should be understood that these approaches are exemplary and in other arrangements other approaches may be used.

The exemplary arrangements provide for suitable lubrication and heat absorption from the areas of abutting engagement between the spool of the distributor plate, particularly in circumstances when an axially inward load is applied to the rotating spool. The exemplary arrangement reduces the risks that such externally applied loads on the shaft the machine will cause excessive heat or wear within the machine. Further the exemplary arrangement reduces the risk of breakdown in the viscosity and lubricating properties of the hydraulic fluid and damage to the bearings of the machine. Of course the approaches described are exemplary and in other arrangements other approaches may be used.

Thus the exemplary arrangements achieve improved operation, eliminate difficulties encountered in the use of prior devices, and attain the useful results that are described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful features and relationships are not limited to the exact features and relationships that have been shown and described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes, and relationships are set forth in the appended claims.

I claim:

1. Apparatus comprising:

a hydraulic machine including a housing, wherein the housing includes a working section, and a flow control section, wherein the flow control section is operative to cause at least one of hydraulic fluid to be directed to at least one inlet to the working section, and hydraulic fluid to be directed from at least one outlet from the working section, wherein the flow control section includes a spool, wherein the spool is rotatable within a cylindrical bore of the housing, is rotatable about an axis, includes fluid passages which are configured to direct hydraulic fluid flow, includes an axially extending recess, wherein the axially extending recess is configured to receive a rotatable shaft that is in rotatable operative connection with the working section, is axially bounded by a radially extending annular wall having a front face, wherein the front face extends radially between the axially extending recess and a circumferential area outside the spool, a distributor plate, wherein the distributor plate extends within the housing axially intermediate of the working section and in the control section, and includes a central distributor plate opening, wherein the central distributor plate opening is configured to have the rotatable shaft extend therein, a plurality of distributor plate openings, wherein the distributor plate openings are configured to enable flow of hydraulic fluid therethrough, an annular plate face contact area, wherein the front face of the spool is in rotatable abutting engagement with the annular plate face contact area, at least one groove, wherein each groove extends transversely into at least one of the annular plate face contact area and the front face, and radially entirely across the front face, wherein each groove fluidly connects the axially extending recess and the circumferential area outside the spool, and is configured to enable hydraulic fluid flow through the groove and radially entirely across each of the front face and the annular plate face contact area between the axial recess and the circumferential area, whereby the passage of hydraulic fluid through the at least one groove is operative to at least one of reduce friction and absorb heat from the front face and the annular plate face contact area.

2. The apparatus according to claim 1 wherein the at least one groove further extends in a direction that extends both radially and circumferentially relative to the spool.

3. The apparatus according to claim 1 wherein a respective groove of the at least one groove further extends in a direction that extends both radially and circumferentially relative to the spool, wherein the respective groove has a respective maximum groove width transverse to the direction, wherein the respective groove has a respective length in a circumferential direction which is larger than the respective maximum groove width.

4. The apparatus according to claim 1 wherein a respective groove of the at least one groove further extends in a direction that extends both radially and circumferentially relative to the spool, wherein the respective groove extends in a circumferential direction a length which is larger than a radial width of the front face.

5. The apparatus according to claim 1 wherein the at least one groove extends in the front face and has a curved configuration.

6. The apparatus according to claim 1 wherein the at least one groove extends in the plate face contact area and has a curved configuration.

7. The apparatus according to claim 1 wherein a respective groove of the at least one groove extends in the front face, wherein the respective groove extends between a radially inner groove opening to the axially extending recess, and a radially outer groove opening to the circumferential area, wherein the radially inner groove opening and the radially outer groove opening are angularly offset from one another in a circumferential direction.

8. The apparatus according to claim 1 wherein the at least one groove has a single gradient.

9. The apparatus according to claim 1 wherein hydraulic fluid flows radially in each groove.

10. The apparatus according to claim 1 wherein the at least one groove comprises a single groove that extends in the front face.

11. The apparatus according to claim 1 wherein the working section comprises a gerotor.

12. The apparatus according to claim 1 wherein the working section comprises a gerotor, wherein the gerotor includes an orbital and axially rotational star wheel and a stationary ring gear, wherein the rotatable shaft is in operative rotatable connection with the star wheel.

13. The apparatus according to claim 1 wherein the working section comprises a gerotor, wherein the gerotor includes an orbital and axially rotational star wheel and a stationary ring gear, wherein the rotatable shaft comprises a cardan shaft that is in operative rotatable connection with the star wheel.

14. The apparatus according to claim 1 wherein the fluid passages of the spool include a pair of axially spaced radially inward extending circumferential grooves, a plurality of angularly spaced radially inward extending first axial grooves that each extend in intersecting relation with a first one of the circumferential grooves but not a second one of the circumferential grooves, a plurality of angularly spaced radially inward extending second axial grooves that each extend in intersecting relation with the second one of the circumferential grooves but not the first one of the circumferential grooves, wherein at least one of the circumferential grooves at least partially radially outwardly overlies the axially extending recess.

15. The apparatus according to claim 1 wherein the hydraulic machine comprises either a hydraulic motor or a hydraulic pump.

16. Apparatus comprising:

a hydraulic machine including a housing, wherein the housing includes a gerotor, a spool, wherein the spool is rotatable within the housing about an axis, is in operative rotatable connection with the gerotor, includes fluid passages configured to direct hydraulic fluid flow, includes a central axially extending recess, wherein the axially extending recess is axially bounded by a radially extending annular wall, wherein the annular wall includes a plate engaging face, a distributor plate, wherein the distributor plate includes a plurality of plate fluid openings configured to pass hydraulic fluid therethrough, includes an annular plate face contact area, wherein the plate engaging face of the spool is in abutting rotational engagement with the annular plate face contact area, wherein at least one of the plate engaging face and annular plate face contact area includes at least one hydraulic fluid conducting groove therein, wherein the at least one hydraulic fluid conducting groove is configured to conduct hydraulic fluid radially through the at least one groove and radially entirely across the plate engaging face that is in abutting rotational engagement with the annular plate face contact area such that both the entire plate engaging face and the entire annular plate face contact area are exposed to the hydraulic fluid within the at least one groove.

17. The apparatus according to claim 16, wherein the at least one hydraulic fluid conducting groove extends in a direction both radially and circumferentially relative to the spool.

18. Apparatus comprising:

a hydraulic machine including a housing, a gerotor within the housing, a spool, wherein the spool is rotatable within the housing about an axis, in operative rotatable connection with the gerotor, wherein the spool includes grooves configured to conduct hydraulic fluid, including first and second axially disposed, radially inward extending circumferential grooves, a plurality of angularly spaced first radially inward and axially extending grooves, wherein each of the first axially extending grooves is in intersecting relation with the first circumferential groove but not the second circumferential groove, a plurality of angularly spaced second radially inward and axially extending grooves, wherein each of the second axially extending grooves is in intersecting relation with the second circumferential groove but not the first circumferential groove, wherein the spool further includes a central axially extending recess, a radially extending annular spool wall, wherein the axially extending recess extends axially inward within the spool from the annular spool wall, wherein the annular spool wall includes a plate engaging face surface, a distributor plate, wherein the distributor plate includes a plurality of plate fluid openings configured to conduct hydraulic fluid through each of the plate fluid openings, an annular plate face contact surface, wherein the plate engaging face surface of the spool rotates in abutting engagement with the annular plate face contact surface, wherein at least one of the plate engaging face surface and the annular plate face contact surface includes a curved radially extending groove that is operative to conduct hydraulic fluid flow through the groove between the plate engaging face surface and the annular plate face contact surface, and radially entirely across the plate engaging face surface, wherein the entire plate engaging face surface and the entire annular plate face contact surface are exposed to hydraulic fluid flow within the groove during spool rotation which at least one of reduces friction and absorbs heat.

19. Apparatus comprising:

a hydraulic machine including a housing, wherein the housing includes a working section, and a flow control section, wherein the flow control section is operative to cause at least one of hydraulic fluid to be directed to at least one inlet to the working section, and hydraulic fluid to be directed from at least one outlet from the working section, wherein the flow control section includes a spool, wherein the spool is rotatable within a cylindrical bore of the housing, is rotatable about an axis, includes fluid passages which are configured to direct hydraulic fluid flow, includes an axially extending recess, wherein the axially extending recess is configured to receive a rotatable shaft that is in rotatable operative connection with the working section, is axially bounded by a radially extending annular wall having a front face, wherein the front face extends radially intermediate of the axially extending recess and a circumferential area outside the spool, a distributor plate, wherein the distributor plate extends within the housing axially intermediate of the working section and the control section, and includes a central distributor plate opening, wherein the central distributor plate opening is configured to have the rotatable shaft extend therein, a plurality of distributor plate openings, wherein the distributor plate openings are configured to enable flow of hydraulic fluid therethrough, an annular plate face contact area, wherein the front face of the spool is in rotatable abutting engagement with the annular plate face contact area, at least one groove, wherein the at least one groove extends radially across at least one of the annular plate face contact area and the front face, and has a depth of not greater than 1 mm, wherein the at least one groove is configured to enable hydraulic fluid flow through the groove and radially across each of the front face and the annular plate face contact area between the axial recess and the circumferential area, whereby the passage of hydraulic fluid through the at least one groove is operative to at least one of reduce friction and absorb heat from the front face and the annular plate face contact area.

20. Apparatus comprising:

a hydraulic machine including a housing, wherein the housing includes a working section, and a flow control section, wherein the flow control section is operative to cause at least one of hydraulic fluid to be directed to at least one inlet to the working section, and hydraulic fluid to be directed from at least one outlet from the working section, wherein the flow control section includes a spool, wherein the spool is rotatable within a cylindrical bore of the housing, is rotatable about an axis, includes fluid passages which are configured to direct hydraulic fluid flow, includes an axially extending recess, wherein the axially extending recess is configured to receive a rotatable shaft that is in rotatable operative connection with the working section, is axially bounded by a radially extending annular wall having a front face, wherein the front face extends radially intermediate of the axially extending recess and a circumferential area outside the spool, a distributor plate, wherein the distributor plate extends within the housing axially intermediate of the working section and the control section, and includes a central distributor plate opening, wherein the central distributor plate opening is configured to have the rotatable shaft extend therein, a plurality of distributor plate openings, wherein the distributor plate openings are configured to enable flow of hydraulic fluid therethrough, an annular plate face contact area, wherein the front face of the spool is in rotatable abutting engagement with the annular plate face contact area, at least one groove, wherein the at least one groove extends radially across at least one of the plate face contact area and the front face, and has a depth of not greater than 0.3 mm, wherein the at least one groove is configured to enable hydraulic fluid flow through the groove and radially across each of the front face and the annular plate face contact area between the axial recess and the circumferential area, whereby the passage of hydraulic fluid through the at least one groove is operative to at least one of reduce friction and absorb heat from the front face and the annular plate face contact area.

* * * * *